United States Patent [19]

Borriello

[11] 4,196,902

[45] Apr. 8, 1980

[54] DEVICE FOR FACIAL EXERCISING TO BE APPLIED IN THE ORAL CAVITY

[76] Inventor: Maria Borriello, 67, Viale Regina Margherita, Pescara 65100, Italy

[21] Appl. No.: 901,636

[22] Filed: May 1, 1978

[51] Int. Cl.[2] ..... A63B 23/00

[52] U.S. Cl. ..... 272/95

[58] Field of Search ..... 272/95; 128/136

[56] References Cited

U.S. PATENT DOCUMENTS

| | | | |
|---|---|---|---|
| 1,466,559 | 8/1923 | Purdy | 272/95 |
| 1,953,088 | 4/1934 | Purdy | 272/95 |
| 3,089,487 | 5/1963 | Enicks | 128/136 |
| 3,178,820 | 4/1965 | Kesling | 128/136 |
| 3,386,732 | 6/1968 | Robins | 272/95 |
| 3,528,655 | 9/1970 | Ruderian | 272/95 |
| 3,547,433 | 12/1970 | Robins | 272/95 |

FOREIGN PATENT DOCUMENTS

| | | | |
|---|---|---|---|
| 151137 | 9/1920 | United Kingdom | 272/95 |

*Primary Examiner*—Richard J. Johnson

*Attorney, Agent, or Firm*—Finnegan, Henderson, Farabow, Garrett & Dunner

[57] ABSTRACT

The invention relates to a device for facial exercising to be applied in the oral cavity, comprising a piece of non-toxic yielding material having an anatomic crescent shape, provided with an inner core allowing to suit the curvature of the device to any form of oral cavity.

4 Claims, 2 Drawing Figures

DEVICE FOR FACIAL EXERCISING TO BE APPLIED IN THE ORAL CAVITY

BACKGROUND OF THE INVENTION

1. Field of the Invention

The present invention relates to a device for facial exercising to be applied in the oral cavity, allowing to exercise facial muscles in order to keep unaltered tonus and therefore freshness of face and neck.

2. Description of the Prior Art

The problem of avoiding face and neck wrinkles by carying out facial exercising, is known since a long time and several attempts were effected to carry out a device to be applied in the oral cavity allowing to carry out this facial exercising.

Examples of these devices of the prior art are those described and illustrated in the U.S. Pat. Nos. 3,286,576; 3,295,519; 3,386,732; 3,525,520; 3,528,655; 3,547,433; 3,744,485; and 3,924,850, as well as in French Pat. No. 627,083. Many devices to protect dental arches from possible hits are also known, such as those described in the U.S. Pat. Nos. 3,089,487 and 3,112,744. The latter devices have a different field of application and in spite of some similarity of shape, they are not adapted to carry out facial exercising, as this requires a precise technique and therefore devices especially designed and shaped for this exercising.

As to the above mentioned devices of the prior art which were especially designed for facial exercising, it is to be noted that they are mostly designed to develop more particularly the labial muscles. In general they are devices to be applied between teeth and lips and therefore they show a strong narrowness of action because they are active on a very little part of the muscles of face and neck.

The devices illustrated in the above mentioned patents of the prior art neither solved the problem to provide a device which is at the same time functional and adaptable to the different existing conformations of the oral cavity. This fact prevents inter alia the standardization of production and practially to commercialize the device on a large scale.

It is also easy to see that the devices illustrated in the above mentioned patents of the prior art are generally cumbersome to be kept in the mouth and just for this reason they cause a feeling of repulsion and a sense of unpleasantness and sometimes of a true nausea. In all these known devices the shape of the device is complicated because they come from the wrong principle that the more complicated is their shape and the more effective is the action of the device, thus obtaining the opposite result to have a limited action which is strictly conditioned by the shape of the device.

Another considerable drawback of these devices of the prior art is that the use of these cumbersome devices with a complicated shape, may cause irritation of the labial mucosae as there is a direct contact between the device and these mucosae. This contact may also cause a hypersecretion of saliva which is detrimental to the organism.

SUMMARY OF THE INVENTION

The object of the present invention is to remove these serious drawbacks of the devices of the prior art, and to provide a device for facial exercising which is of simple structure and universal use.

The device for facial exercising according to the present invention is applied in the mouth between the teeth and through a motion of forced mastication, allows to set going directly and indirectly a considerable number of muscles of face and neck, such as masseter, risorius, superciliary, platysma, eye, mouth and lip muscles so as to effect a beneficial action of tonicization of said muscles also by increasing the local blood circulation.

The device according to the present invention is of a single design, but may be suited to all shapes of the oral cavity, it is practical and easy to be used, it is not cumbersome to be kept in the mouth and causes neither irritation of the mucosae nor hypersecretion of saliva.

The device for facial exercising according to the present invention consists of a single piece of a blend of non-toxic melted vegetal rubber giving to the device the required strength and elasticity. The device has an anatomic crescent shape, particularly designed to warrant a uniform pressure on both dental arches, and is provided with an inner core of soft alloy such as nickel-plated iron wire, so that the device can be suited to any shape of oral cavity.

It is important that the device of the present invention is made with a melt of absolutely non-toxic vegetal rubber, as plastic materials and other similar substances with time, wear and daily contact with mouth secretions, may release chemical substances detrimental to the oral cavity and consequently to the human organism in general. Of course other absolutely non-toxic materials of a quality equivalent to the vegetal rubber may also be used.

The device according to the present invention is to be kept in the mouth between the teeth and carrying out a normal motion of mastication it sets going many muscles of face and neck, helping them to keep tonus and elasticity. Thus the facial muscles are hardened and tonicized, labial furrows are removed, forehead and eye wrinkles are prevented, while in odontotherapy the device may be used with advantage as a means to strengthen dental arches and to avoid formation of pyorrhea and stomatitis. The device may also help re-education of the maxillary and masticatory function after jaw fractures and injuries e.g. because of a road accident.

The objects, features and advantages of the device for facial exercising according to the present invention will be apparent and clear from the following detailed description of a preferred embodiment of it, which is given by way of non limiting example only, with reference to the figures of the accompanying sheet of illustrative drawings, in which:

DETAILED DESCRIPTION OF THE PREFERRED EMBODIMENT

Figure 2:
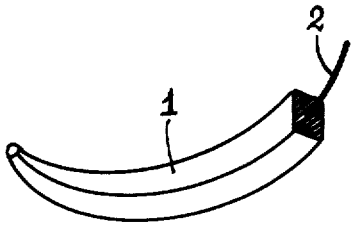
FIG. 2 is a similar perspective view, but partially broken away to show the inner structure of the device.
Figure 1:
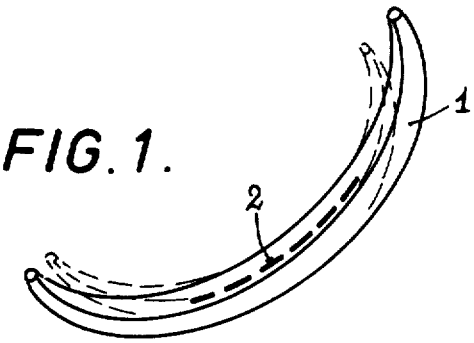
FIG. 1 is a perspective view of the device for facial exercising according to the present invention.

With reference now to the figures of the accompanying drawings, the device for facial exercising according to the present invention consists of a piece 1, having an anatomic crescent shape, made of a blend of melted non-toxic vegetal rubber, and provided with an inner core 2 of soft alloy, allowing to suit the device to any shape of oral cavity. In fact in FIG. 1 the broken lines are showing the way in which the device can be bent more or less in order to conform to the different shapes of oral cavity.

It has to be noted that the inner core 2 is not extending up to the two end points of piece 1, so as to allow to cut away a portion of piece 1 at each end, in the event that it is too long for particularly small oral cavities and the points would touch the palate bottom.

It is to be understood that several modifications, variations, additions and/or substitutions of details may be made to the device for facial exercising according to the present invention, without departing however from spirit and scope of the invention as defined in the appended claims.

I claim:

1. A device for facial exercising for use in the mouth between the upper and lower teeth comprising a crescent-shaped piece of non-toxic resilient material the cross section of which tapers from its mid portion toward a point portion at each end and an inner core of bendable material embedded within the resilient material so that the curvature of the device may be altered to fit the mouth.

2. The device of claim 1, wherein the resilient material is rubber.

3. The device of claim 1, wherein the inner core is a nickel-plated iron wire.

4. The device of claim 1, wherein the inner core does not extend up to the two end point portions so that said portions may be cut away to reduce the length of the device.

* * * * *